US007476818B2

(12) United States Patent
Nam

(10) Patent No.: US 7,476,818 B2
(45) Date of Patent: Jan. 13, 2009

(54) UNIFIED POWER WINDOW SWITCH FOR VEHICLE

(75) Inventor: Bum Woo Nam, Incheon (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 11/900,255

(22) Filed: Sep. 11, 2007

(65) Prior Publication Data

US 2008/0169180 A1 Jul. 17, 2008

(30) Foreign Application Priority Data

Oct. 11, 2006 (KR) ..... 10-2006-0125265

(51) Int. Cl.
*H01H 9/02* (2006.01)

(52) U.S. Cl. ..... 200/5 R

(58) Field of Classification Search ..... 200/5 R, 200/6 A, 17 R, 18; 345/156, 157, 160, 161, 345/184

See application file for complete search history.

(56) References Cited

U.S. PATENT DOCUMENTS

| | | | | |
|---|---|---|---|---|
| 4,473,724 | A * | 9/1984 | Suzuki | 200/5 R |
| 5,034,572 | A * | 7/1991 | Kouno et al. | 200/5 R |
| 5,128,500 | A * | 7/1992 | Hirschfeld | 200/5 R |
| 5,233,228 | A * | 8/1993 | Krieg | 307/10.1 |
| 6,528,740 | B2 * | 3/2003 | Miyoshi | 200/5 R |
| 6,608,263 | B2 * | 8/2003 | Myojin | 200/16 D |
| 6,689,967 | B2 * | 2/2004 | Myojin | 200/18 |
| 6,831,238 | B1 * | 12/2004 | Lau | 200/6 A |
| 6,953,900 | B2 * | 10/2005 | Sottong | 200/5 R |
| 7,060,915 | B2 * | 6/2006 | Bricaud et al. | 200/5 R |
| 7,301,111 | B2 * | 11/2007 | Kondo et al. | 200/4 |

FOREIGN PATENT DOCUMENTS

| | | |
|---|---|---|
| JP | 09-161612 | 6/1997 |
| JP | 11-086666 | 3/1999 |
| JP | 2002-075132 | 3/2002 |
| KR | 1020050022927 | 3/2005 |
| KR | 1020060068419 | 6/2006 |
| KR | 1020060068994 | 6/2006 |

* cited by examiner

*Primary Examiner*—Michael A Friedhofer
(74) *Attorney, Agent, or Firm*—Peter F. Corless; Edwards Angell Palmer & Dodge LLP

(57) ABSTRACT

The present invention relates to a unified power window switch for a vehicle that can open and close all the windows of the vehicle and further provide a window lock function. The unified power window switch comprises a substrate including on its top surface a rear left (RL) side first conductive line, a front left (FL) side first conductive line, a front right (FR) side first conductive line, a rear right (RR) side first conductive line, and a power supply first conductive line, and on its bottom surface an RL side second conductive line, an FL side second conductive line, an FR side second conductive line, an RR side second conductive line, and a power supply second conductive line. The switch further comprises: an RL, FL, FR, and RR side motors; a guide body attached on the top surface of the substrate; a left/right moving plate movably connected to the up and down inner surfaces of the guide body; an up/down moving plate movably connected to the inner surfaces of the left/right moving plate; a contact plate positioned on the bottom surface of the substrate; a case connected to the top portion of the substrate; and a selector switch knob connected to the top of the up/down moving plate.

11 Claims, 20 Drawing Sheets

FL WINDOW OPERATION MODE

FR WINDOW OPERATION MODE

RL WINDOW OPERATION MODE

RR WINDOW OPERATION MODE

FL & FR WINDOW OPERATION MODE

RL & RR WINDOW OPERATION MODE

FL & RL WINDOW OPERATION MODE

FR & RR WINDOW OPERATION MODE

UNIFIED POWER WINDOW SWITCH FOR VEHICLE

CROSS-REFERENCE TO RELATED APPLICATION

This application claims priority under 35 U.S.C. §119(a) on Korean Patent Application No. 10-2006-0125265 filed on Dec. 11, 2006, the entire contents of which are incorporated herein by reference.

BACKGROUND OF THE INVENTION

1. Technical Field

The present invention relates to a unified power window switch for a vehicle and, more particularly to a unified power window switch for a vehicle that can open and close all windows of the vehicle and further lock the windows.

2. Background Art

A power window switch for a vehicle is used to open and close a front left (FL; driver's seat side) window, a front right (FR; passenger's seat side) window, a rear left RL window and a rear right RR window.

Typically, a power window switch is mounted on front doors of a vehicle and another power window switch is mounted on rear doors. However, in light of the safety, a unified switch which is mounted on driver's seat and can be controlled by a driver may be preferred.

As depicted in FIG. 5, a typical unified power window switch comprises four separate switches for opening and closing FL, FR, RL and RR side windows, respectively, and lock switches for locking the respective windows. However, such a power window switch hardly serves as a 'unified' switch since it is composed of a plurality of separate switches, not a single switch. Due to the structure, a driver may feel inconvenient to operate the switches for opening and closing the respective windows.

Japanese Patent No. 2002-075132 discloses a window switch which includes a joystick-like operating element for opening and closing plural windows. With the joystick-like operating element, however, a driver cannot precisely perceive a direction of the operating element. For this reason, the driver oftentimes is required to visually confirm the direction of the operating element and the driver can be distracted, which can cause a serious safety problem.

The information disclosed in this Background of the Invention section is only for enhancement of understanding of the background of the invention and should not be taken as an acknowledgement or any form of suggestion that this information forms the prior art that is already known to a person skilled in the art.

SUMMARY OF THE INVENTION

Accordingly, the present invention has been made to provide a unified power window switch that can execute eight opening/closing operation modes, such as a single opening/closing operation of an FL side window, a single opening/closing operation of an FR side window, a single opening/closing operation of an RL side window, a single opening/closing operation of an RR side window, a simultaneous opening/closing operation of the FL and FR side windows, a simultaneous opening/closing operation of the RL and RR side windows, a simultaneous opening/closing operation of the FL and RL side windows and a simultaneous opening/closing operation of the FR and RR side windows, and can execute locking functions.

In a preferred embodiment, the present invention provides a unified power window switch for a vehicle comprising a substrate having conductive lines, motors coupled to the conductive lines, a guide body attached on the substrate, left/right and up/down moving plates, a contact plate, a selector switch knob and a case.

The substrate includes on its top surface a rear left (RL) side first conductive line, a front left (FL) side first conductive line, a front right (FR) side first conductive line, a rear right (RR) side first conductive line, and a power supply first conductive line, which lines are arranged spaced apart from each other at regular intervals. The substrate includes on its bottom surface an RL side second conductive line, an FL side second conductive line, an FR side second conductive line, an RR side second conductive line, and a power supply second conductive line, which lines are arranged spaced apart from each other at regular intervals.

An RL side motor is coupled between the RL side first conductive line and the RL side second conductive line. An FL side motor is coupled between the FL side first conductive line and the FL side second conductive line. An FR side motor is coupled between the FR side first conductive line and the FR side second conductive line. An RR side motor is coupled between the RR side first conductive line and the RR side second conductive line.

The guide body is in a rectangular ring shape and attached on the top surface of the substrate.

The left/right moving plate is movably connected to the up and down inner surfaces of the guide body for applying an electric current to at least one of the conductive lines on the substrate.

The up/down moving plate is inserted into a connecting hole penetrating the middle of the substrate and movably connected to the inner surfaces of the left/right moving plate for applying an electric current to at least one of the conductive lines on the substrate.

The contact plate is positioned on the bottom surface of the substrate and connected to the up/down moving plate in a body for applying an electric current to at least one of the conductive lines on the substrate.

The case is connected to the top portion of the substrate to cover the substrate. The case defines a through-hole formed in the middle of the case.

The selector switch knob is connected to the top of the up/down moving plate via the through-hole of the case.

In a further preferred embodiment, the left/right moving plate has the shape of Πand includes a first guide groove formed in the left and right directions on the top and bottom surfaces thereof and a second guide groove formed in the up and down directions on the inner surfaces thereof.

In a still further preferred embodiment, the guide body is provided with a first guide end which is formed in the left and right directions on the up and down inner surfaces of the guide body so as to be inserted into the first guide groove of the left/right moving plate.

In yet a still further preferred embodiment, the up/down moving plate is provided with a second guide end which is formed in the up and down direction on the left and right lateral surfaces of the up/down moving plate so as to be inserted into the second guide groove of the left/right moving plate.

In another preferred embodiment, the up/down moving plate is provided with a connecting rod which is formed in the middle of the bottom surface of the up/down moving plate in a body and the contact plate defines therein a connecting hole through which the connecting rod is inserted.

In still another preferred embodiment, the selector switch knob is provided with a connecting projection which is formed on the bottom surface of the selector switch knob and the up/down moving plate defines in the middle of its top surface a connecting groove through which the connecting projection is inserted.

In yet another preferred embodiment, the up/down moving plate comprises a first conducting plate on its bottom surface and the contact plate comprises a second conducting plate on its top surface, both of which conducting plates have same shape and arranged symmetrically. Further, each of the first and second conducting plates may comprise on its surface a main conducting terminal, upper, lower, left and right conducting terminals. Preferably, the upper, lower, left and right conducting terminals are cross-shaped. Also preferably, the main conducting terminal is electrically connected to the power supply first and second conductive lines, the upper, lower, left and right conducting terminals.

In still yet another preferred embodiment, a unified power window switch may further comprise a window up/down operation switch between the power supply first and second conductive lines. Preferably, the UP side of the window up/down operation switch is connected to the power supply first conductive line and the DOWN side of the window up/down operation switch is connected to the power supply second conductive line.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like. The present unified power window switches will be particularly useful with a wide variety of motor vehicles.

Other aspects of the invention are discussed infra.

BRIEF DESCRIPTION OF THE DRAWINGS

The above and other features of the present invention will be described with reference to certain exemplary embodiments thereof illustrated the attached drawings in which.

DETAILED DESCRIPTION OF THE PREFERRED EMBODIMENTS

Hereinafter, preferred embodiments in accordance with the present invention will be described with reference to the accompanying drawings. The preferred embodiments are provided so that those skilled in the art can sufficiently understand the present invention, but can be modified in various forms and the scope of the present invention is not limited to the preferred embodiments.

Figure 1A:
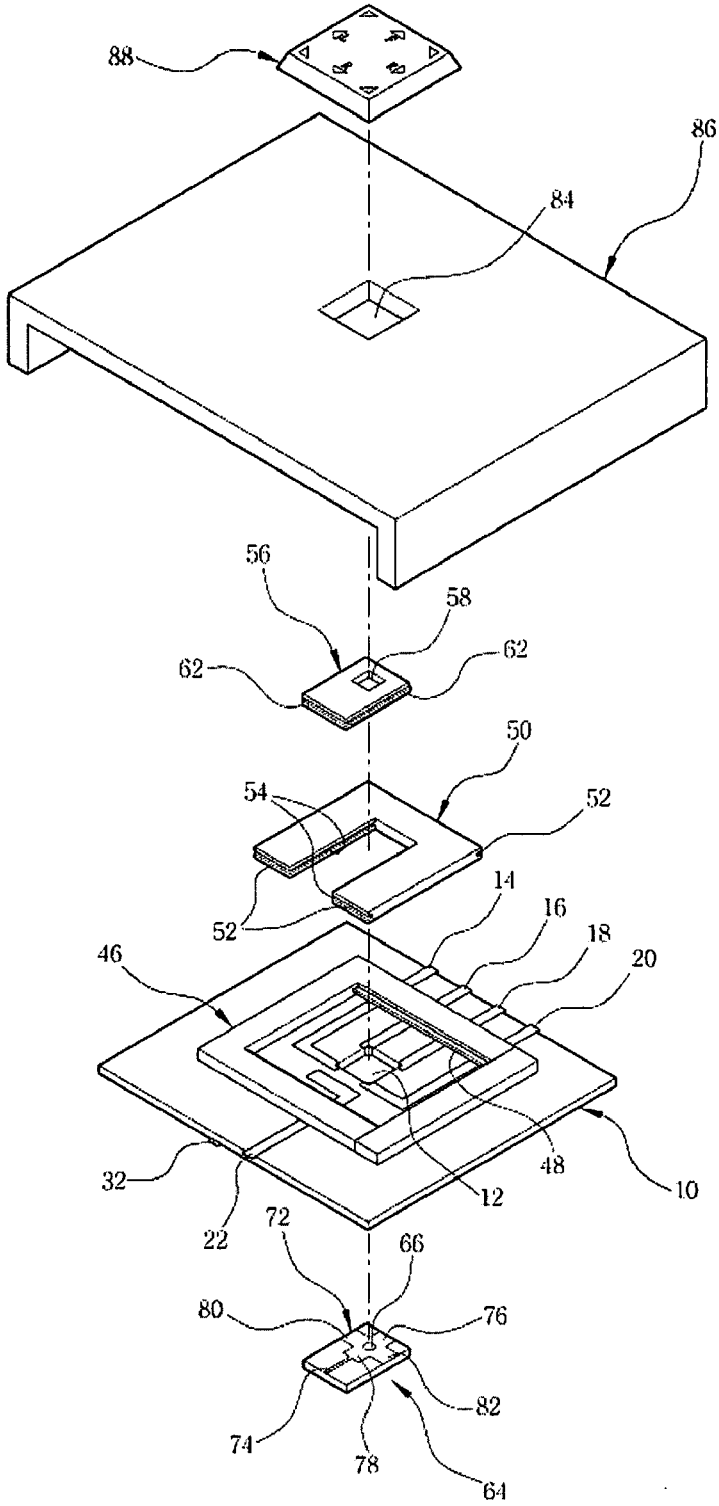
FIGS. 1A and 1B are exploded perspective views depicting a unified power window switch in accordance with a preferred embodiment of the present invention.
Figure 1B:
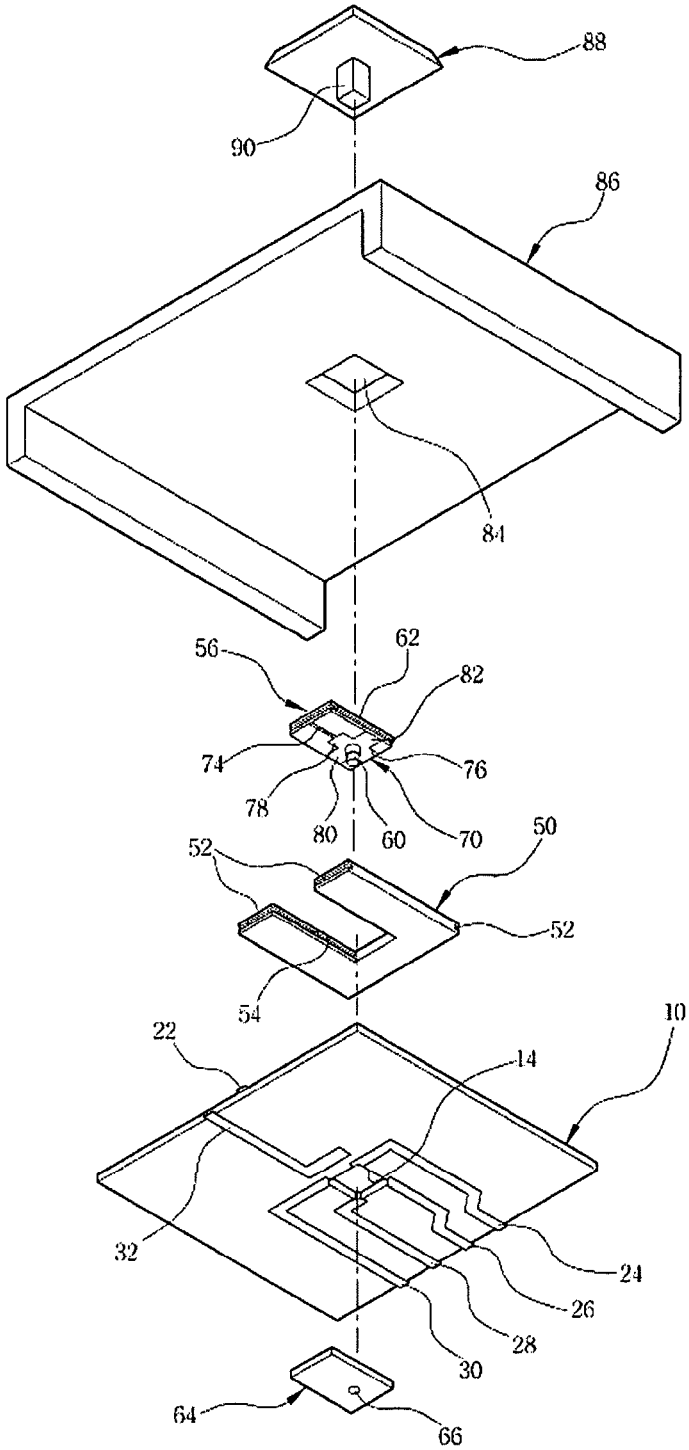
Figure 2:
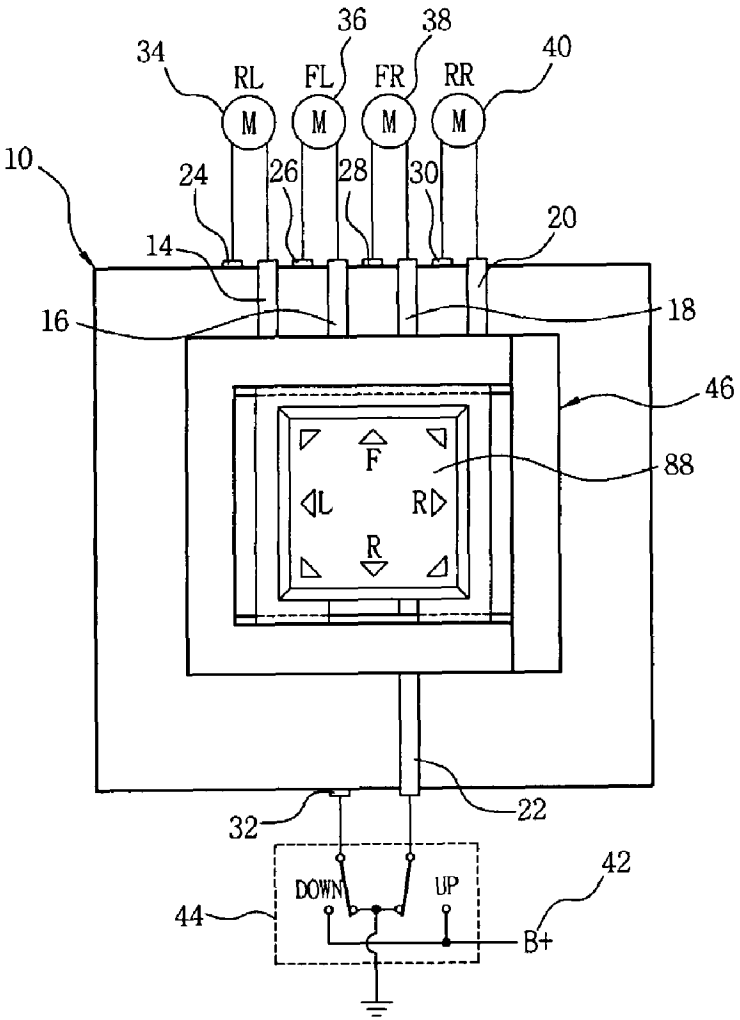
FIG. 2 is a top view depicting a unified power window switch in accordance with a preferred embodiment of the present invention.

FIGS. 1A and 1B are exploded perspective views depicting a unified power window switch in accordance with a preferred embodiment of the present invention, and FIG. 2 is a top view depicting a unified power window switch in accordance with a preferred embodiment of the present invention.

The present invention aims at unifying eight opening/closing operation modes, such as a single opening/closing operation of a front left (FL) side window, a single opening/closing operation of a front right (FR) side window, a single opening/closing operation of a rear left (RL) side window, a single opening/closing operation of a rear right (RR) side window, a simultaneous opening/closing operation of the FL and FR side windows, a simultaneous opening/closing operation of the RL and RR side windows, a simultaneous opening/closing operation of the FL and RL side windows and a simultaneous opening/closing operation of the FR and RR side windows, and a window lock function to a single power window switch.

The unified power window switch in accordance with the present invention comprises a substrate 10, an up/down moving plate 56, a left/right moving plate 50, a contact plate 64, a selector switch knob 88 and a case 86.

The substrate 10 is made of an insulating material in the form of a rectangular plate. The substrate 10 defines therein a connecting hole 12.

An RL side first conductive line 14, an FL side first conductive line 16, an FR side first conductive line 18, an RR side first conductive line 20 and a power supply first conductive line 22 are arranged spaced apart from each other at regular intervals on the top surface of the substrate 10 from the left to the right side.

In more detail, the RL side first conductive line 14 and the RR side first conductive line 20 in the form of "L" are attached on left and right sides on the top surface of the substrate 10. The FL side first conductive line 16 and the FR side first conductive line 18 in the form of an approximate straight line having a shorter length are attached between the RL side first conductive line 14 and the RR side first conductive line 20.

Moreover, the power supply first conductive line 22 is arranged on the substrate 10 so as to be positioned below the FL side first conductive line 16 and the FR side first conductive line 18 and between the lower ends of the RL side first conductive line 14 and the RR side first conductive line 20.

On the bottom of the substrate 10 are conductive lines which are electrically connected to and symmetrically arranged with the RL side first conductive line 14, the FL side first conductive line 16, the FR side first conductive line 18, the RR side first conductive line 20 and the power supply first conductive line 22, respectively.

That is, an RL side second conductive line 24, an FL side second conductive line 26, an FR side second conductive line 28, an RR side second conductive line 30 and a power supply second conductive line 32, which have the same forms as those conductive lines 14, 16, 18, 20 and 22, are arranged in the same arrangement on the bottom of the substrate 10.

In addition, an RL side motor 34 is coupled between the RL side first and second conductive lines 14, 24 for driving the RL side window up and down. An FL side motor 36 is coupled between the FL side first and second conductive lines 16, 26 for driving the FL side window up and down. An FR side motor 38 is coupled between the FR side first and second conductive lines 18, 28 for driving the FR side window up and down, and an RR side motor 40 is coupled between the RR side first and second conductive lines 20, 30 for driving the RR side window up and down.

A window up/down operation switch 44 connected to a battery 42 is coupled between the power supply first and second conductive lines 22, 32 so as to supply battery power to the respective motors 34, 36, 38 and 40.

Here, an UP side of the window up/down operation switch 44 is connected to the power supply first conductive line 22 and a DOWN side of the window up/down operation switch 44 is coupled to the power supply second conductive line 32.

In addition, a guide body 46 is attached on the top surface of the substrate 10. The guide body 46 is made of an insulating material in the form of a rectangular ring.

As depicted in FIGS. 3A to 3H, the top end of the guide body 46 is arranged so as to cross the RL side first conductive line 14, the FL side first conductive line 16, the FR side first conductive line 18 and the RR side first conductive line 20. The bottom end of the guide body 46 is arranged so as to cross the power supply first conductive line 22. The left and right ends of the guide body 46 are spaced outside the RL side first conductive line 14 and the RR side first conductive line 20, respectively.

A first guide end 48 extending in the left and right directions is formed on the top and bottom insides of the guide body 46. The first guide ends 48 are inserted into first guide grooves 52 of the left/right moving plate 50.

The left/right moving plate 50 is an insulating structure connected to the guide body 46 so as to be movable in the left and right directions. The left/right moving plate 50 is in the form of Πwhen viewing from the top.

A first guide groove 52 extending in the left and right directions is formed on the top and bottom surfaces of the left/right moving plate 50, and a second guide groove 54 is established on both insides the left/right moving plate 50.

The left/right moving plate 50 can be moved in the left and right directions in the guide body 46 as the first guide ends 48 of the guide body 46 are inserted into the first guide grooves 52 formed on the top and bottom surfaces of the left/right moving plate 50 so as to be moved slidably along the first guide grooves 52.

Next, the up/down moving plate 56 is connected to the inside of the left/right moving plate 50 so as to be moved in the up and down direction, in which a connecting groove 58 is formed in the middle of the top surface thereof and a connecting rod 60 is formed in a body in the middle of the bottom surface thereof.

Accordingly, the up/down moving plate 56 is inserted into the connecting hole 12 which penetrates the middle of the substrate 10 and, at the same time, connected to the second guide grooves 54 formed in the inside of the left/right moving plate 50 so as to be moved straight in the up and down directions.

That is, as second guide ends 62 formed protruding from the left and right lateral surfaces of the up/down moving plate 56 are inserted into the second guide grooves 54 of the left/right moving plate 50 so to be slidably movable, the up/down moving plate 56 can be moved in the up and down directions in the inside of the left/right moving plate 50.

Meanwhile, a contact plate 64 connected with the up/down moving plate 56 so as to be moved along the same is positioned on the bottom of the substrate 10. Here, the connecting rod 60 of the up/down moving plate 56 is inserted into a connecting hole 66 formed on the top surface of the contact plate 64 to be connected with each other.

Conductive means are arranged on the up/down moving plate and the contact plate as follows. A first conducting plate 70 applying an electric current to at least one of the conductive lines on the top surface of the substrate 10 is attached on the bottom surface of the up/down moving plate 56. A second conducting plate 72 applying an electric current to at least one of the conductive lines on the bottom of the substrate 10 is attached on the top surface of the contact plate 64. The first and second conducting plates 70, 72 are arranged symmetrically and have the same shape.

Each of the first and second conducting plates 70, 72 comprises on its surface a main conducting terminal, upper, lower, left and right conducting terminals. The upper, lower, left and right conducting terminals are cross-shaped. The main conducting terminal is electrically connected to the power supply first and second conductive lines, the upper, lower, left and right conducting terminals.

That is, although each of the first and second conducting plates 70, 72 is divided into the main conducting terminal 74, the upper, lower, left and right conducting terminals, it is an integrated conducting plate comprised of those terminals, in which the top end of the main conducting terminal 74 and the bottom end of the lower conducting terminal 78 are connected to each other in a body, the left and right conducting terminals 80 and 82 are coupled to each other in a body on the top of the lower conducting terminal 78, and the upper conducting terminal 76 is connected to the top ends of the left and right conducting terminals 80 and 82 in a body.

Accordingly, the upper, lower, left and right conducting terminals 76, 78, 80 and 82 are connected to each other in the cross arrangement on the top of the main conducting terminal 74.

Meanwhile, a case 86 defining therein a through-hole 84 is mounted to the top portion of the substrate 10. The case covers the substrate and protects the left/right moving plate 50, the up/down moving plate 56 and the respective conductive lines from the outside.

Also, a selector switch knob 88 to be operated in the up and down directions and in the left right directions is mounted in the middle of the top surface of the case 86. A connecting projection 90 is formed on the bottom surface of the selector switch knob 88. Accordingly, as the connecting projection 90 is inserted into the through-hole 84 of the case 86 and then inserted into the connecting groove 58 formed in the middle of the top surface of the up/down moving plate 56, the selector switch knob 88 is connected to the up/down moving plate 56.

Next, the respective operation modes of the unified power window switch in accordance with preferred embodiments of the present invention as described above will be described as follows.

FIGS. 3A to 3H are top views illustrating the respective operation modes selected according to the moving directions of the up/down moving plate and the left/right moving direction of the unified power window switch in accordance with a preferred embodiment of the present invention, and FIGS. 4A to 4H are top and bottom views illustrating contact operations according to the respective operation modes of the unified power window switch in accordance with a preferred embodiment of the present invention.

Figure 3A:
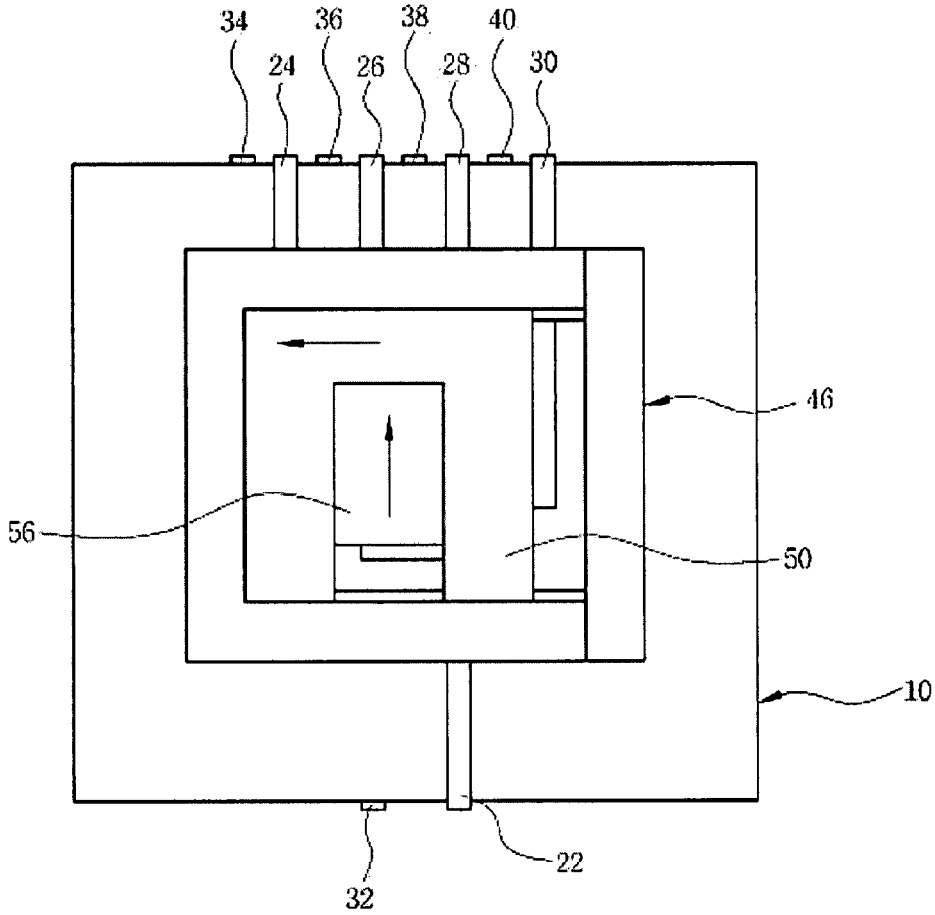
FIGS. 3A to 3H are top views illustrating the operation methods according to respective operation modes of a unified power window switch in accordance with a preferred embodiment of the present invention.
Figure 4A:
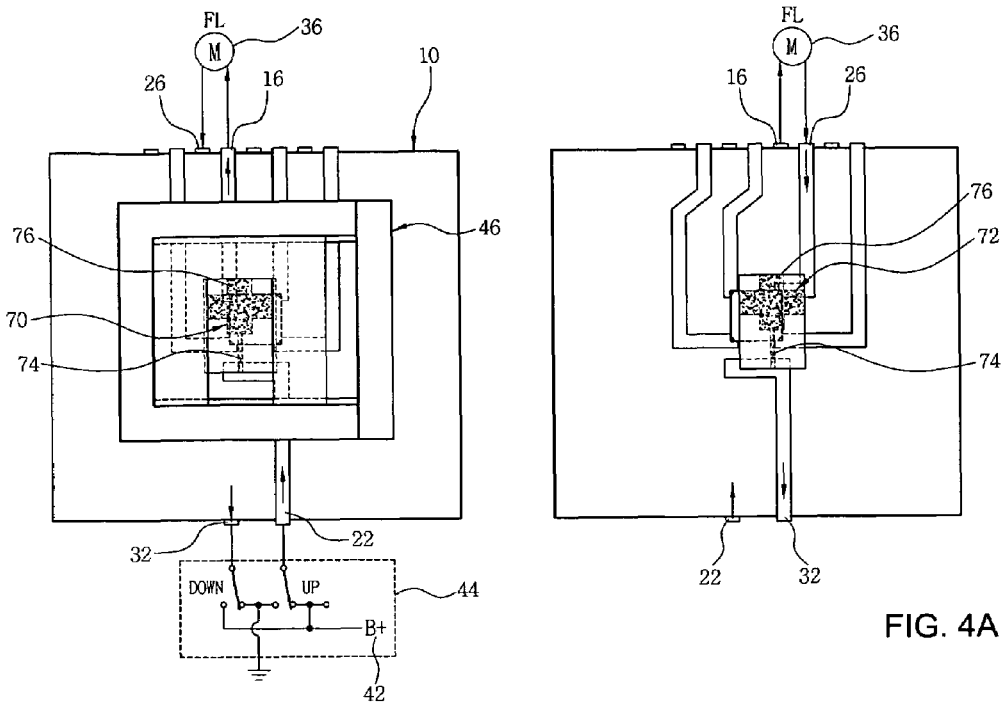
FIGS. 4A to 4H are top and bottom views illustrating contact operations according to respective operation modes of a unified power window switch in accordance with a preferred embodiment of the present invention.

(1) Single Opening/Closing Operation Mode of the FL Side Window (Refer to FIGS. 3A and 4A)

First, the selector switch knob 88 is moved by hand straight in the up direction and, at the same time, straight in the left direction.

According to the movement of the selector switch knob 88 in the up direction, the second guide ends 62 of the up/down moving plate 56 are slidably moved in the up direction along the second guide grooves 54 of the left/right moving plate 50 and the up/down moving plate 56 is thereby moved in the up direction.

Subsequently, according to the movement of the selector switch knob 88 in the left direction, the first guide ends 48 of the guide body 46 are slid in situ in the first guide grooves 52 of the left/right moving plate 50 and the left/right moving plate 50 is thereby moved left. Here, the up/down moving plate 56 is being moved in the left direction along the left/right moving plate 50.

Accordingly, only the upper conducting terminal 76 of the first conducting plate 70 of the up/down moving plate 56 is being electrically connected to the FL side first conductive line 16 on the substrate 10.

Subsequently, if the window up/down operation switch 44 is operated to the UP side, the battery power is applied to the main conducting terminal 74 of the first conducting plate 70 through the power supply first conducive line 22 and, at the same time, supplied to the FL side first conductive line 16 through the upper conducting terminal 76 of the first conducting plate 70 so as to drive the FL side motor 36 coupled to the FL side first conductive line 16, thus moving the FL side window upward.

Here, the contact plate 64 is being moved in the same direction along the up/down moving plate 56 and only the FL side second conductive line 26 of the bottom side of the substrate 10 is thereby being electrically connected to the power supply second conductive line 32 by the upper conducting terminal 76 of the second conducting plate 72 attached on the top surface of the contact plate 64.

The ground connection of the FL side motor 36 is made through a grounding point adjacent to the window up/down operation switch 44 in the sequential order of the motor 36, the FL side second conductive line 26, the upper conducting terminal 76 of the second conducting plate 72, the power supply second conductive line 32 and the window up/down operation switch 44.

On the contrary, if the window up/down operation switch 44 is operated to the DOWN side, the battery power is applied to the main conducting terminal 74 of the second conducting plate 72 through the power supply second conducive line 32 and, at the same time, supplied to the FL side second conductive line 26 through the upper conducting terminal 76 of the second conducting plate 72 so as to drive the FL side motor 36 coupled to the FL side second conductive line 26 in the opposite direction, thus moving the FL side window downward.

Of course, the ground connection of the FL side motor 36 is made through a grounding point adjacent to the window up/down operation switch 44 in the sequential order of the motor 36, the FL side first conductive line 16, the upper conducting terminal 76 of the first conducting plate 70, the power supply first conductive line 22 and the window up/down operation switch 44.

Figure 3B:
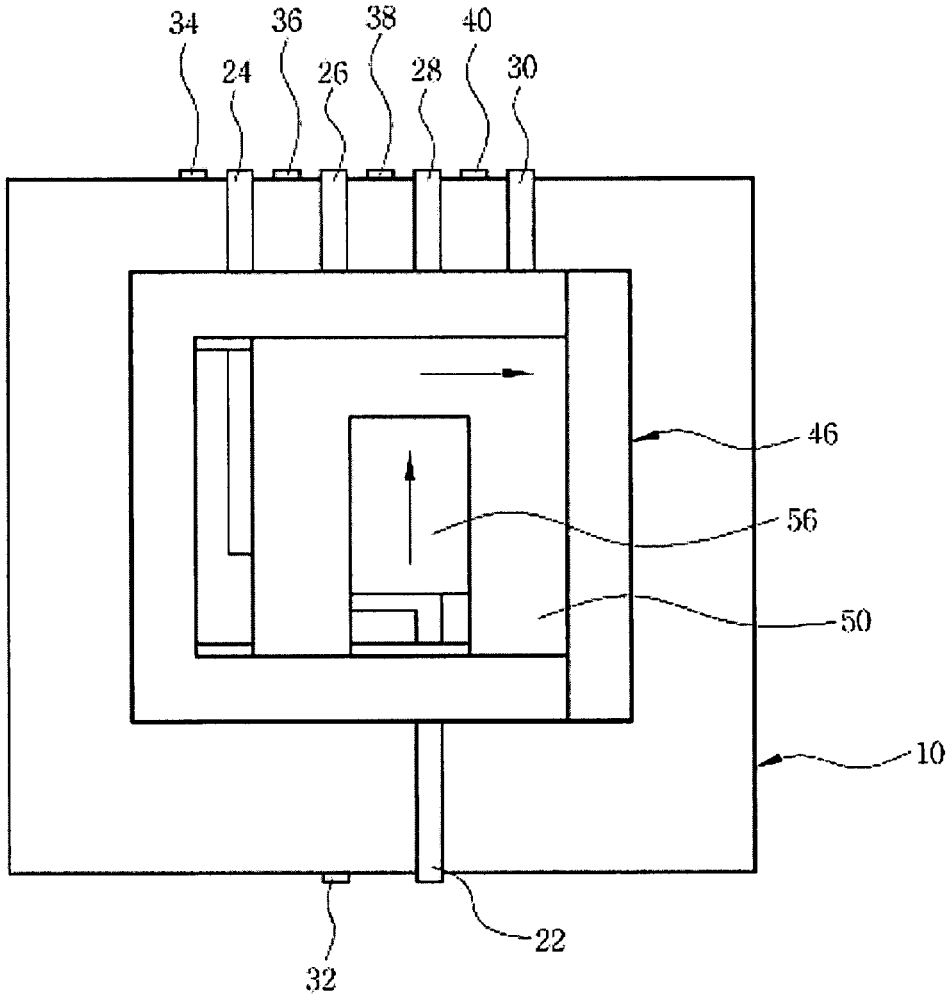
Figure 4B:
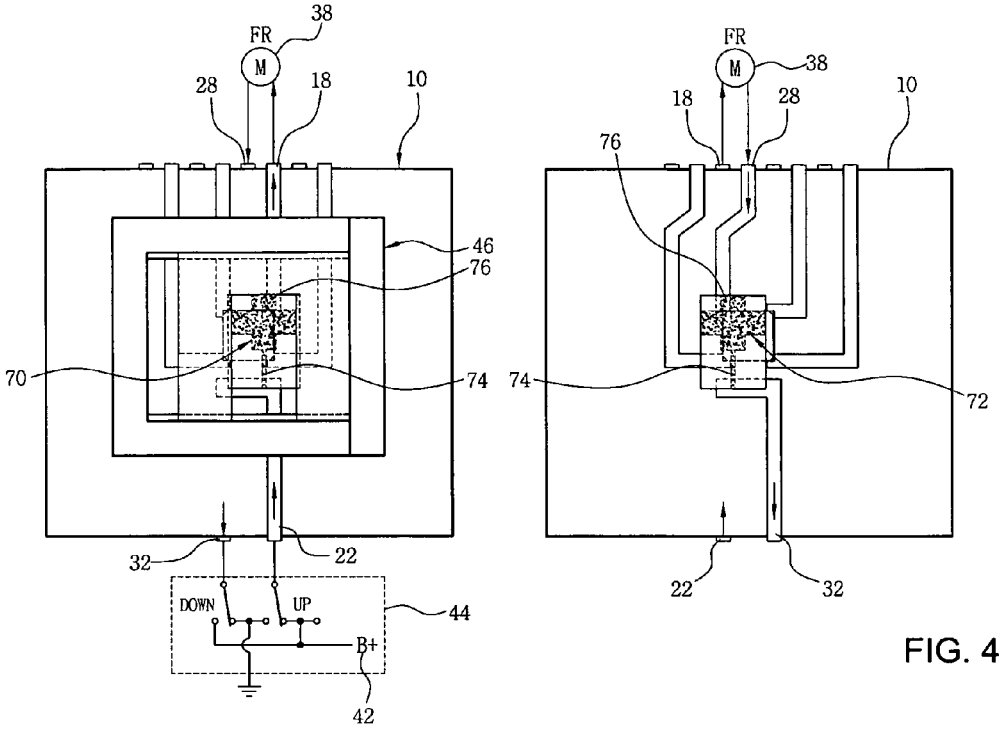

(2) Single Opening/Closing Operation Mode of the FR Side Window (Refer to FIGS. 3B and 4B)

First, the selector switch knob 88 is moved by hand straight in the up direction and, at the same time, moved straight in the right direction.

According to the movement of the selector switch knob 88 in the up direction, the second guide ends 62 of the up/down moving plate 56 are slidably moved in the up direction along the second guide grooves 54 of the left/right moving plate 50 and thereby the up/down moving plate 56 is moved in the up direction.

Subsequently, according to the movement of the selector switch knob 88 in the right direction, the first guide ends 48 of the guide body 46 are slid in situ in the first guide grooves 52 of the left/right moving plate 50 and thereby the left/right moving plate 50 is moved right. Here, the up/down moving plate 56 is being moved in the right direction along the left/right moving plate 50.

Accordingly, only the upper conducting terminal 78 of the first conducting plate 70 of the up/down moving plate 56 is being electrically connected to the FR side first conductive line 18 on the substrate 10.

Subsequently, if the window up/down operation switch 44 is operated to the UP side, the battery power is applied to the main conducting terminal 74 of the first conducting plate 70 through the power supply first conducive line 22 and, at the same time, supplied to the FR side first conductive line 18 through the upper conducting terminal 78 of the first conducting plate 70 so as to drive the FR side motor 38 coupled to the FR side first conductive line 18, thus moving the FR side window upward.

Here, the contact plate 64 is being moved in the same direction along the up/down moving plate 56 and thereby only the FR side second conductive line 28 of the bottom side of the substrate 10 is being electrically connected to the power supply second conductive line 32 by the upper conducting terminal 78 of the second conducting plate 72 attached on the top surface of the contact plate 64.

The ground connection of the FR side motor 38 is made through a grounding point adjacent to the window up/down operation switch 44 in the sequential order of the motor 38, the FR side second conductive line 28, the upper conducting terminal 78 of the second conducting plate 72, the power supply second conductive line 32 and the window up/down operation switch 44.

On the contrary, if the window up/down operation switch 44 is operated to the DOWN side, the battery power is applied to the main conducting terminal 74 of the second conducting plate 72 through the power supply second conducive line 32 and, at the same time, supplied to the FR side second conductive line 28 through the upper conducting terminal 78 of the second conducting plate 72 so as to drive the FR side motor 38 coupled to the FR side second conductive line 28 in the opposite direction, thus moving the FR side window downward.

Of course, the ground connection of the FR side motor 38 is made through a grounding point adjacent to the window up/down operation switch 44 in the sequential order of the motor 38, the FR side first conductive line 18, the upper conducting terminal 78 of the first conducting plate 70, the power supply first conductive line 22 and the window up/down operation switch 44.

Figure 3C:
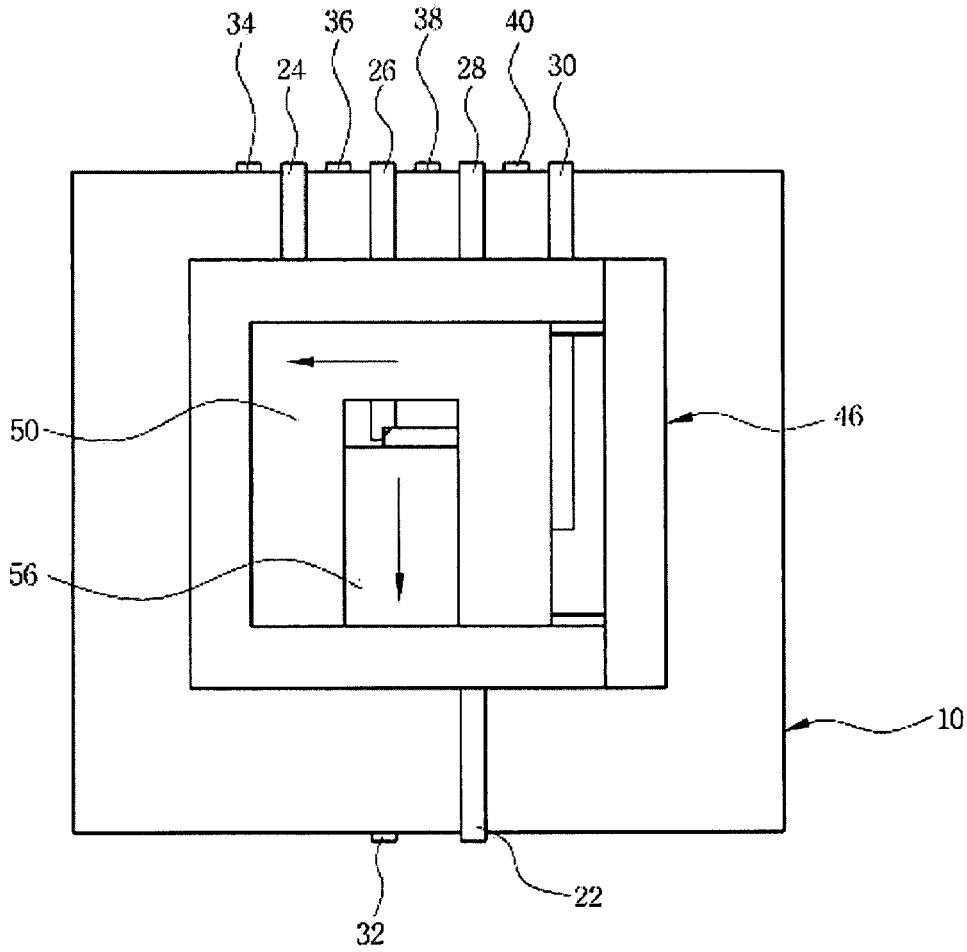
Figure 4C:
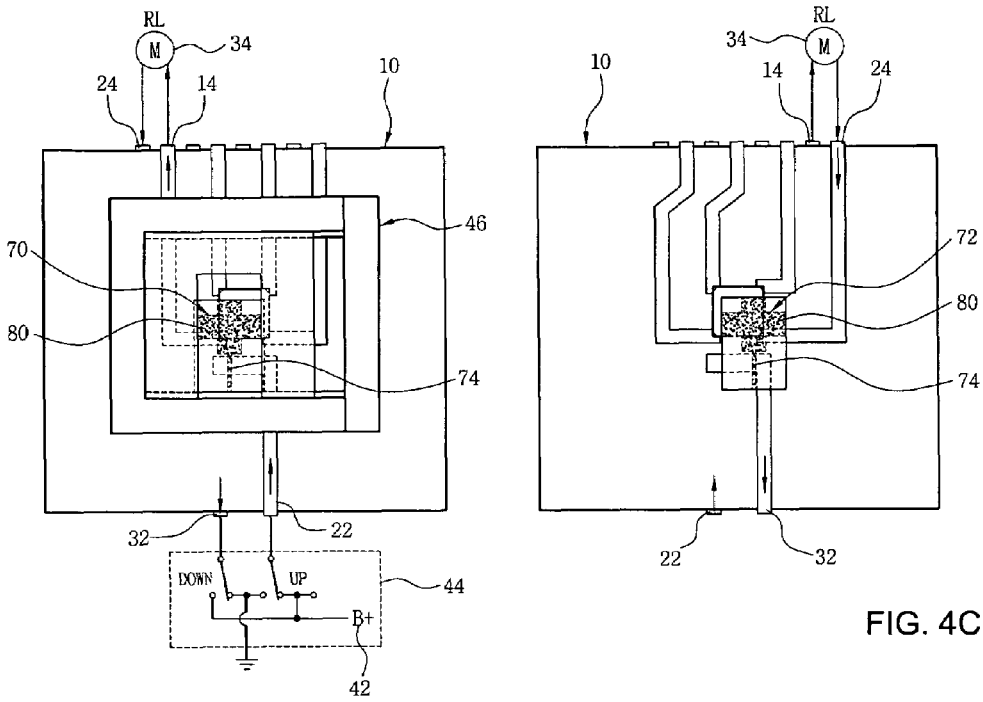

(3) Single Opening/Closing Operation Mode of the RL Side Window (Refer to FIGS. 3C and 4C)

First, the selector switch knob 88 is moved by hand straight in the down direction and, at the same time, moved straight in the left direction.

According to the movement of the selector switch knob 88 in the down direction, the second guide ends 62 of the up/down moving plate 56 are slidably moved in the down direction along the second guide grooves 54 of the left/right moving plate 50 and thereby the up/down moving plate 56 is moved in the down direction.

Subsequently, according to the movement of the selector switch knob 88 in the left direction, the first guide ends 48 of the guide body 46 are slid in situ in the first guide grooves 52 of the left/right moving plate 50 and thereby the left/right moving plate 50 is moved left. Here, the up/down moving plate 56 is being moved in the left direction along the left/right moving plate 50.

Accordingly, only the left conducting terminal 80 of the first conducting plate 70 of the up/down moving plate 56 is being electrically connected to the RL side first conductive line 14 on the substrate 10.

Subsequently, if the window up/down operation switch 44 is operated to the UP side, the battery power is applied to the main conducting terminal 74 of the first conducting plate 70 through the power supply first conducive line 22 and, at the same time, supplied to the RL side first conductive line 14 through the left conducting terminal 80 of the first conducting plate 70 so as to drive the RL side motor 34 coupled to the RL side first conductive line 14, thus moving the RL side window upward.

Here, the contact plate 64 is being moved in the same direction along the up/down moving plate 56 and thereby only the RL side second conductive line 24 of the bottom side of the substrate 10 is being electrically connected to the second conductive line 32 by the left conducting terminal 80 of the second conducting plate 72 attached on the top surface of the contact plate 64.

The ground connection of the RL side motor 34 is made through a grounding point adjacent to the window up/down operation switch 44 in the sequential order of the motor 34, the RL side second conductive line 24, the left conducting terminal 80 of the second conducting plate 72, the power supply second conductive line 32 and the window up/down operation switch 44.

On the contrary, if the window up/down operation switch 44 is operated to the DOWN side, the battery power is applied to the main conducting terminal 74 of the second conducting plate 72 through the power supply second conducive line 32 and, at the same time, supplied to the RL side second conductive line 24 through the left conducting terminal 80 of the second conducting plate 72 so as to drive the RL side motor 34 coupled to the RL side second conductive line 24 in the opposite direction, thus moving the RL side window downward.

Of course, the ground connection of the RL side motor 34 is made through a grounding point adjacent to the window up/down operation switch 44 in the sequential order of the motor 34, the RL side first conductive line 14, the left conducting terminal 80 of the first conducting plate 70, the power supply first conductive line 22 and the window up/down operation switch 44.

Figure 3D:
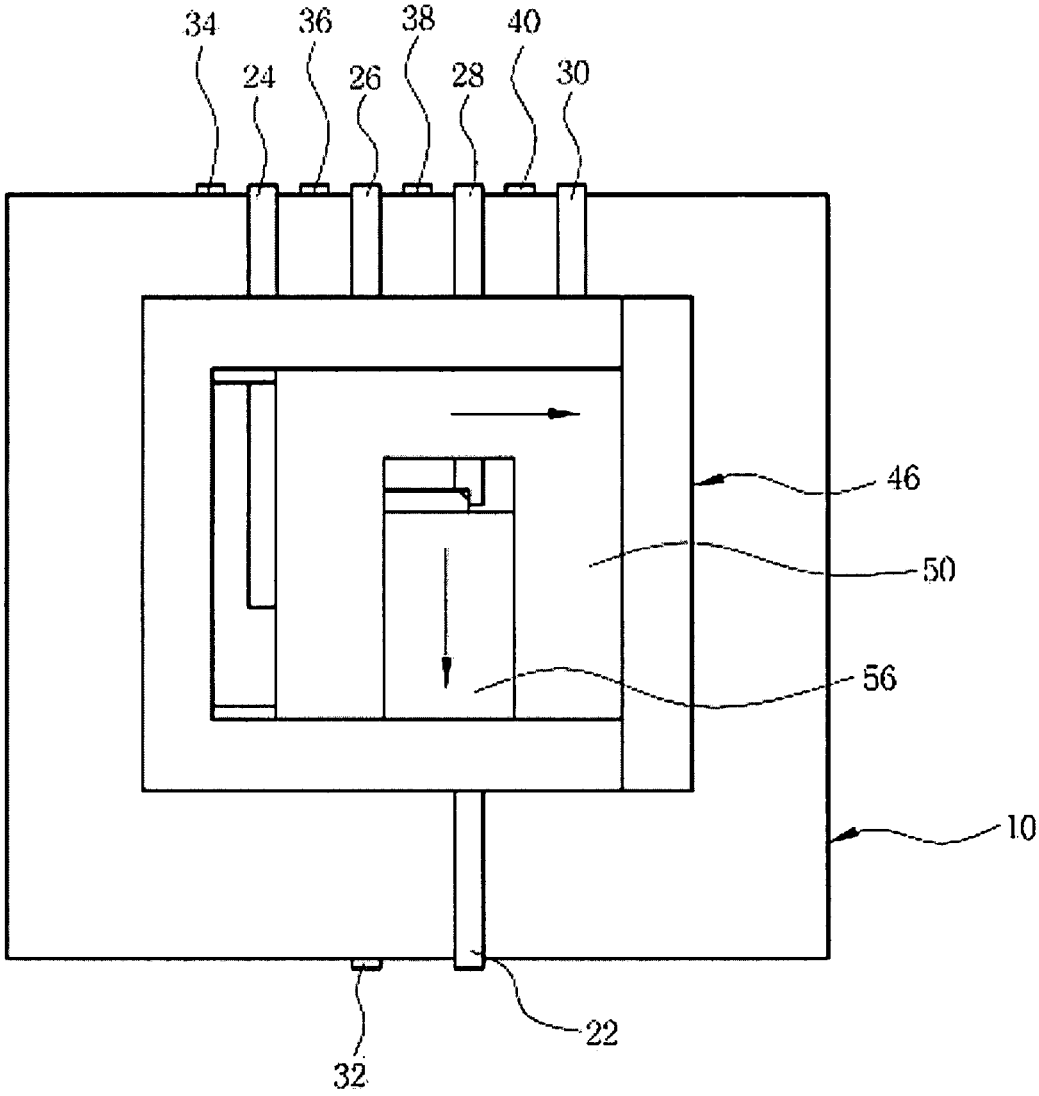
Figure 4D:
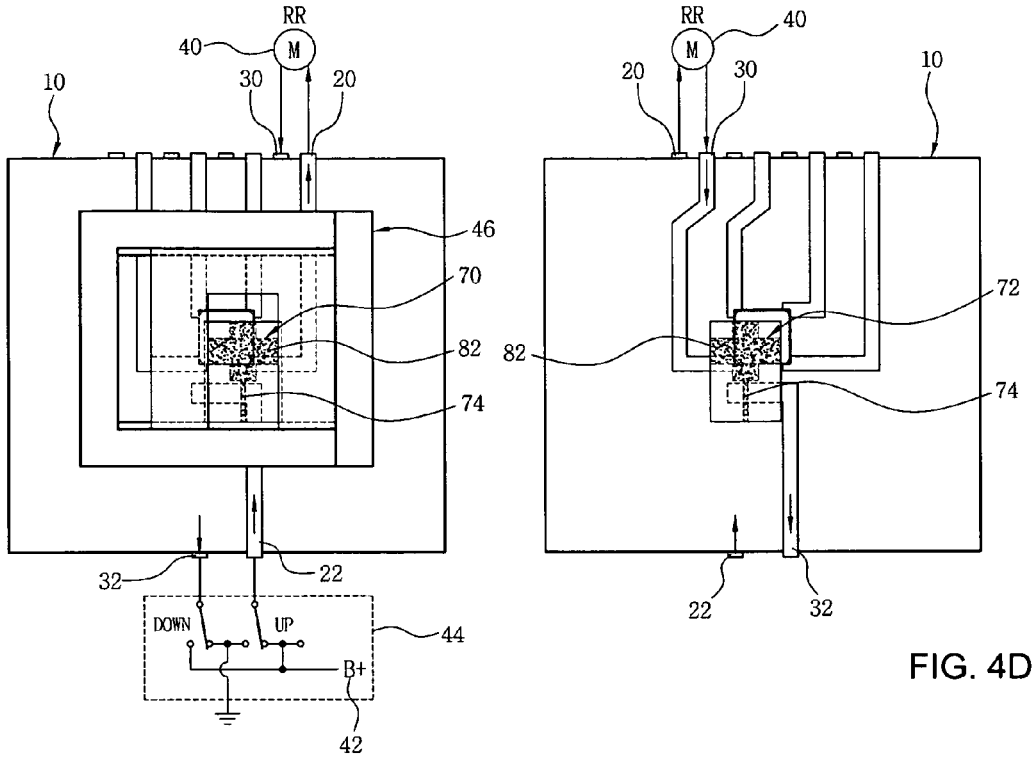

(4) Single Opening/Closing Operation Mode of the RR Side Window (Refer to FIGS. 3D and 4D)

First, the selector switch knob 88 is moved by hand straight in the down direction and, at the same time, moved straight in the right direction.

According to the movement of the selector switch knob 88 in the down direction, the second guide ends 62 of the up/down moving plate 56 are slidably moved in the down direction along the second guide grooves 54 of the left/right moving plate 50 and thereby the up/down moving plate 56 is moved in the down direction.

Subsequently, according to the movement of the selector switch knob 88 in the right direction, the first guide ends 48 of the guide body 46 are slid in situ in the first guide grooves 52 of the left/right moving plate 50 and thereby the left/right moving plate 50 is moved right. Here, the up/down moving plate 56 is being moved in the right direction along the left/right moving plate 50.

Accordingly, only the right conducting terminal 82 of the first conducting plate 70 of the up/down moving plate 56 is being electrically connected to the RR side first conductive line 20 on the substrate 10.

Subsequently, if the window up/down operation switch 44 is operated to the UP side, the battery power is applied to the main conducting terminal 74 of the first conducting plate 70 through the power supply first conducive line 22 and, at the same time, supplied to the RR side first conductive line 20 through the right conducting terminal 82 of the first conducting plate 70 so as to drive the RR side motor 40 coupled to the RR side first conductive line 20, thus moving the RR side window upward.

Here, the contact plate 64 is being moved in the same direction along the up/down moving plate 56 and thereby only the RR side second conductive line 30 of the bottom side of the substrate 10 is being electrically connected to the power supply second conductive line 32 by the right conducting terminal 82 of the second conducting plate 72 attached on the top surface of the contact plate 64.

The ground connection of the RR side motor 40 is made through a grounding point adjacent to the window up/down operation switch 44 in the sequential order of the motor 40, the RR side second conductive line 30, the right conducting terminal 82 of the second conducting plate 72, the power supply second conductive line 32 and the window up/down operation switch 44.

On the contrary, if the window up/down operation switch 44 is operated to the DOWN side, the battery power is applied to the main conducting terminal 74 of the second conducting plate 72 through the power supply second conducive line 32 and, at the same time, supplied to the RR side second conductive line 30 through the right conducting terminal 82 of the second conducting plate 72 so as to drive the RR side motor 40 coupled to the RR side second conductive line 30 in the opposite direction, thus moving the RR side window downward.

Of course, the ground connection of the RR side motor 40 is made through a grounding point adjacent to the window up/down operation switch 44 in the sequential order of the motor 40, the RR side first conductive line 20, the right conducting terminal 82 of the first conducting plate 70, the power supply first conductive line 22 and the window up/down operation switch 44.

Figure 3E:
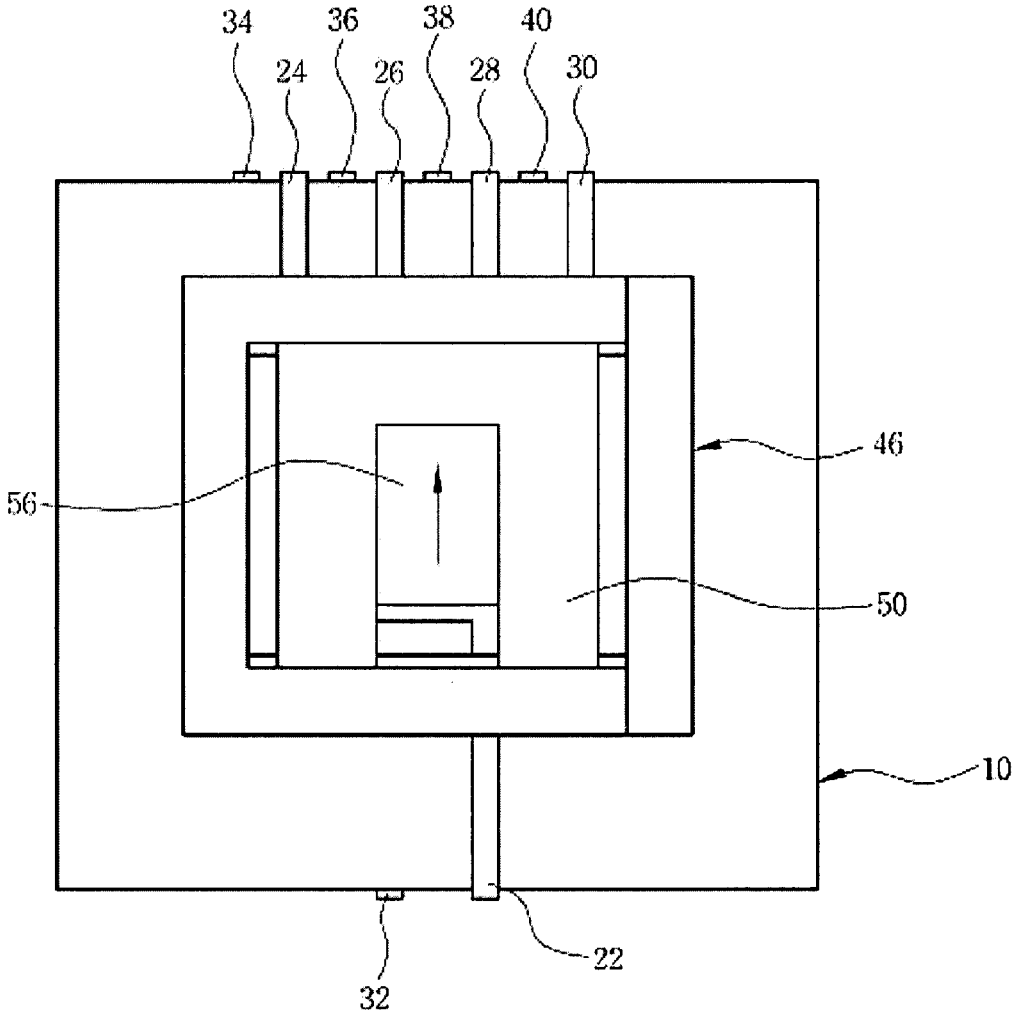
Figure 4E:
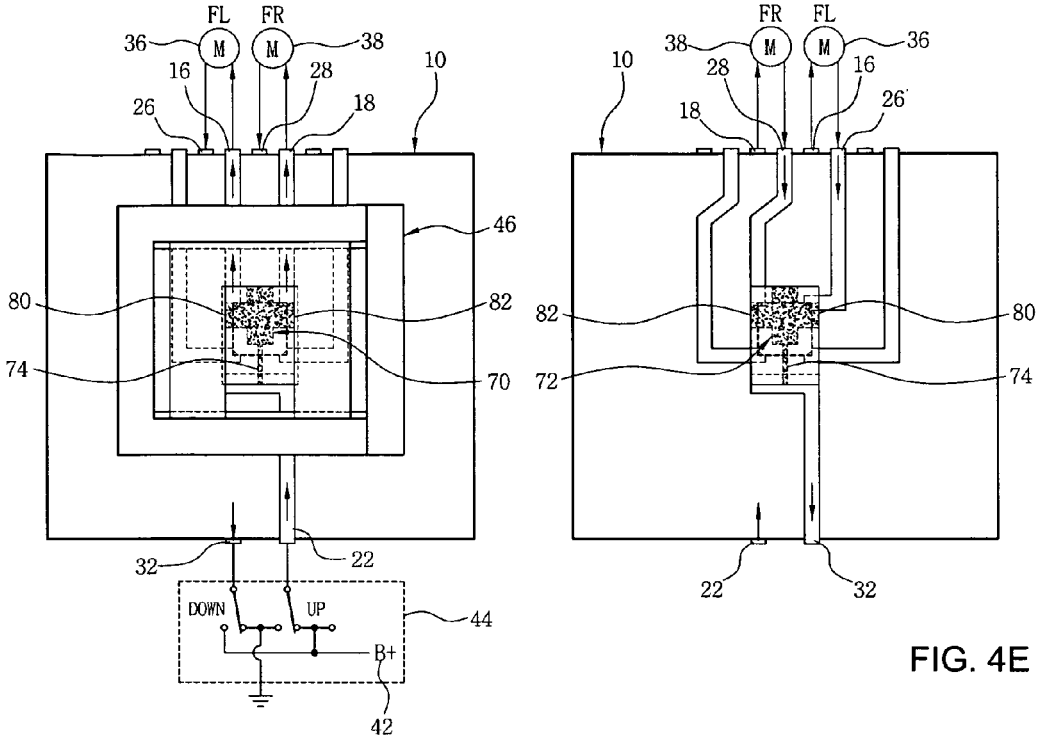

(5) Simultaneous Opening/Closing Operation Mode of the FL and FR Side Windows (Refer to FIGS. 3E and 4E)

First, the selector switch knob 88 is moved by hand straight in the up direction.

According to the movement of the selector switch knob 88 in the up direction, the second guide ends 62 of the up/down moving plate 56 are slidably moved in the up direction along the second guide grooves 54 of the left/right moving plate 50 and thereby the up/down moving plate 56 is moved in the up direction.

Here, the left/right moving plate 50 is not moved but kept in a fixed state (neutral state).

Accordingly, the left and right conducting terminals 80 and 82 of the first conducting plate 70 of the up/down moving plate 56 are being electrically connected to the FL side first conductive line 16 and the FR side first conductive line 18 on the substrate 10, respectively.

Subsequently, if the window up/down operation switch 44 is operated to the UP side, the battery power is applied to the main conducting terminal 74 of the first conducting plate 70 through the power supply first conducive line 22 and, at the same time, supplied to the FL side first conductive line 16 and the FR side first conductive line 18 through the left and right conducting terminals 80 and 82 of the first conducting plate 70 so as to drive the FL side motor 36 coupled to the FL side first conductive line 16 and the FR side motor 38 coupled to the FR side first conductive line 18, thus moving the FL and FR side windows upward simultaneously.

Here, the contact plate 64 is being moved in the same direction along the up/down moving plate 56 and thereby the FL side second conductive line 26 and the FR side second conductive line 28 of the bottom side of the substrate 10 are being electrically connected to the power supply second conductive line 32 by the left and right conducting terminals 80 and 82 of the second conducting plate 72 attached on the top surface of the contact plate 64.

The ground connections of the FL and FR side motors 36 and 38 are made through grounding points adjacent to the window up/down operation switch 44 in the sequential order of the motors 36 and 38, the FL and FR side second conductive lines 26 and 28, the left and right conducting terminals 80 and 82 of the second conducting plate 72, the power supply second conductive line 32 and the window up/down operation switch 44.

On the contrary, if the window up/down operation switch 44 is operated to the DOWN side, the battery power flows in the opposite direction so as to drive the FL and FR side motors 36 and 38, thus moving the FL and FR side windows downward simultaneously.

Figure 3F:
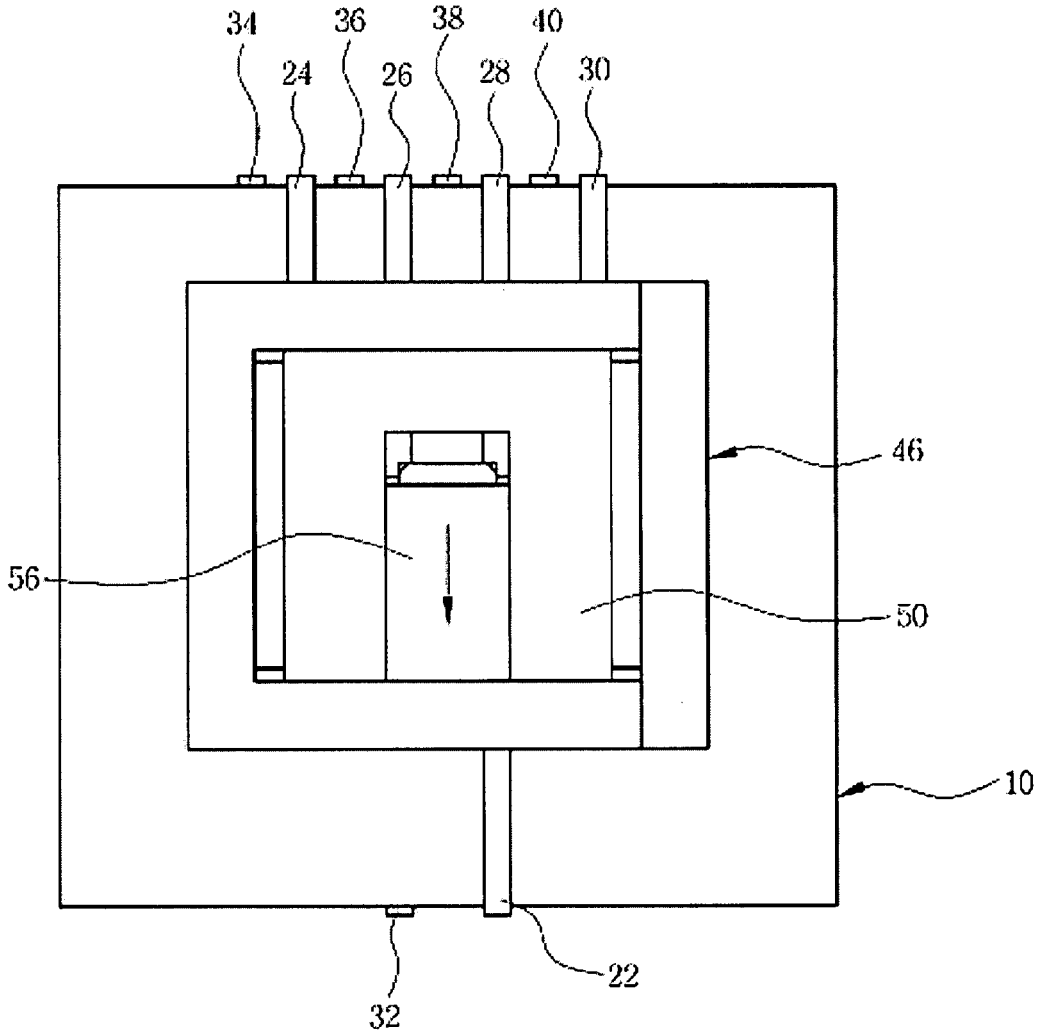
Figure 4F:
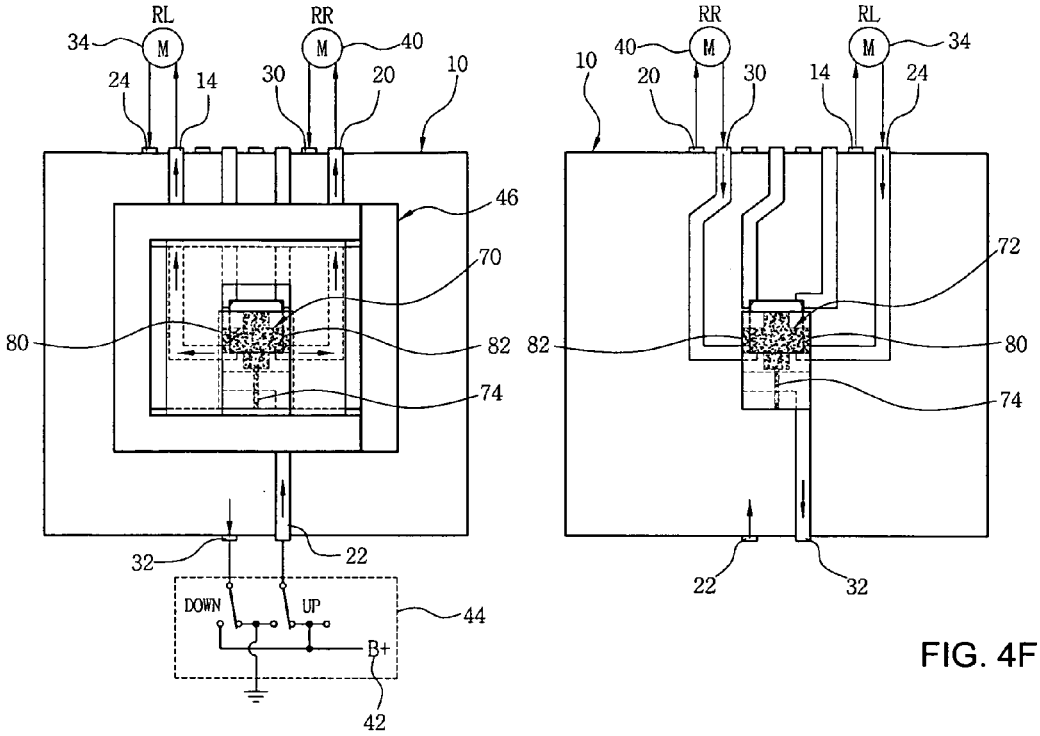

(6) Simultaneous Opening/Closing Operation Mode of the RL and RR Side Windows (Refer to FIGS. 3F and 4F)

First, the selector switch knob 88 is moved by hand straight in the down direction.

According to the movement of the selector switch knob 88 in the down direction, the second guide ends 62 of the up/down moving plate 56 are slidably moved in the down direction along the second guide grooves 54 of the left/right moving plate 50 and thereby the up/down moving plate 56 is moved in the down direction.

Here, the left/right moving plate 50 is not moved but kept in a fixed state (neutral state).

Accordingly, the left and right conducting terminals 80 and 82 of the first conducting plate 70 of the up/down moving plate 56 are being electrically connected to the RL side first conductive line 14 and the RR side first conductive line 20 on the substrate 10, respectively.

Subsequently, if the window up/down operation switch 44 is operated to the UP side, the battery power is applied to the main conducting terminal 74 of the first conducting plate 70 through the power supply first conducive line 22 and, at the same time, supplied to the RL side first conductive line 14 and the RR side first conductive line 20 through the left and right conducting terminals 80 and 82 of the first conducting plate 70 so as to drive the RL side motor 34 coupled to the RL side first conductive line 14 and the RR side motor 40 coupled to the RR side first conductive line 20, thus moving the RL and RR side windows upward simultaneously.

Here, the contact plate 64 is being moved in the same direction along the up/down moving plate 56 and thereby the RL side second conductive line 24 and the RR side second conductive line 30 of the bottom side of the substrate 10 are being electrically connected to the power supply second conductive line 32 by the left and right conducting terminals 80 and 82 of the second conducting plate 72 attached on the top surface of the contact plate 64.

The ground connections of the RL and RR side motors 34 and 40 are made through grounding points adjacent to the window up/down operation switch 44 in the sequential order of the motors 34 and 40, the RL and RR side second conductive lines 24 and 30, the left and right conducting terminals 80 and 82 of the second conducting plate 72, the power supply second conductive line 32 and the window up/down operation switch 44.

On the contrary, if the window up/down operation switch 44 is operated to the DOWN side, the battery power flows in the opposite direction so as to drive the RL and RR side motors 34 and 40, thus moving the RL and RR side windows downward simultaneously.

Figure 3G:
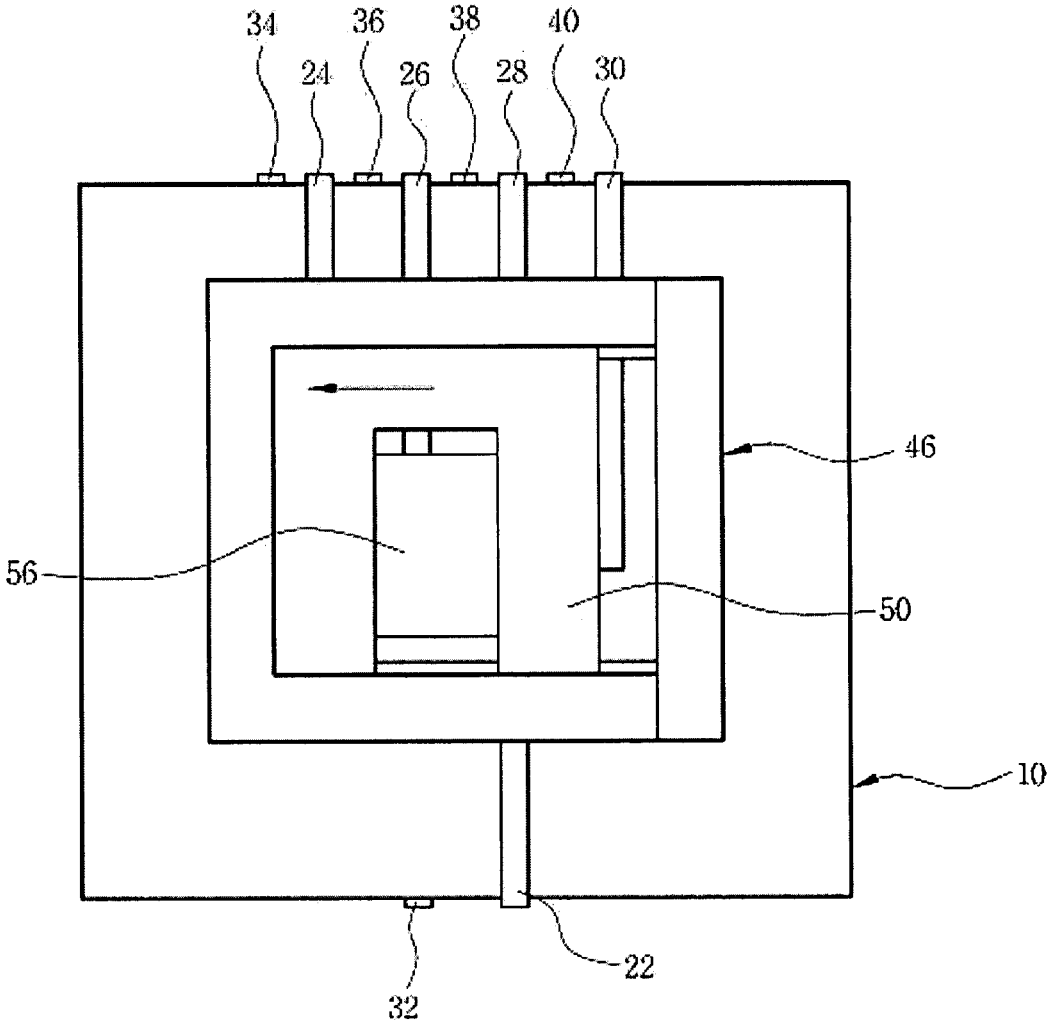
Figure 4G:
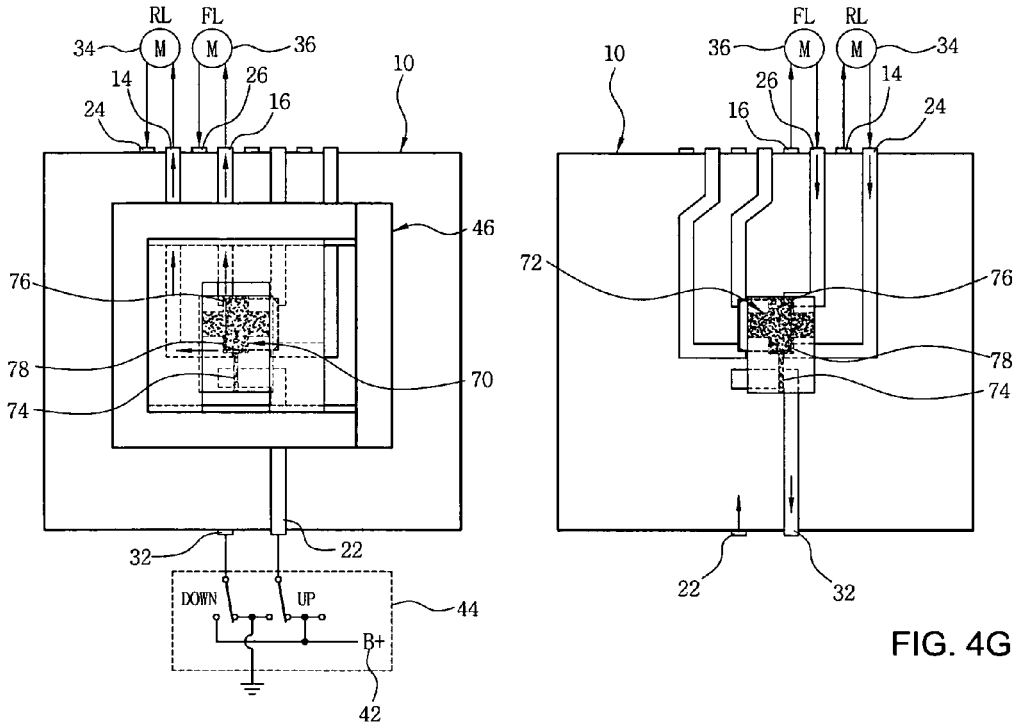

(7) Simultaneous Opening/Closing Operation Mode of the FL and RL Side Windows (Refer to FIGS. 3G and 4G)

First, the selector switch knob 88 is moved by hand straight in the left direction.

According to the movement of the selector switch knob 88 in the left direction, the first guide ends 48 of the guide body 46 are slid in situ in the first guide grooves 52 of the left/right moving plate 50 and thereby the left/right moving plate 50 is moved in the left direction. Here, the up/down moving plate 56 is being moved in the left direction along the left/right moving plate 50.

Here, when the selector switch knob 88 is moved in the left direction, the up/down moving plate 56 is not moved but kept in a fixed state (neutral state).

Accordingly, the upper conducting terminal 76 of the first conducting plate 70 of the up/down moving plate 56 is being electrically connected to the FL side first conductive line 16 and, at the same time, the lower conducting terminal 78 of the first conducting plate 70 is being electrically connected to the RL side first conductive line 14.

Subsequently, if the window up/down operation switch 44 is operated to the UP side, the battery power is applied to the main conducting terminal 74 of the first conducting plate 70 through the power supply first conducive line 22 and, at the same time, supplied to the FL side first conductive line 16 and the RL side first conductive line 14 through the upper and lower conducting terminals 76 and 78 of the first conducting plate 70 so as to drive the FL side motor 36 coupled to the FL side first conductive line 16 and the RL side motor 34 coupled to the RL side first conductive line 14, thus moving the FL and RL side windows upward simultaneously.

Here, the contact plate 64 is being moved in the same direction along the up/down moving plate 56 and thereby the FL side second conductive line 26 and the RL side second conductive line 24 of the bottom side of the substrate 10 are being electrically connected to the power supply second conductive line 32 by the upper and lower conducting terminals 76 and 78 of the second conducting plate 72 attached on the top surface of the contact plate 64.

The ground connections of the FL and RL side motors 36 and 34 are made through grounding points adjacent to the window up/down operation switch 44 in the sequential order of the motors 36 and 34, the FL and RL side second conductive lines 26 and 24, the upper and lower conducting terminals 76 and 78 of the second conducting plate 72, the power supply second conductive line 32 and the window up/down operation switch 44.

On the contrary, if the window up/down operation switch 44 is operated to the DOWN side, the battery power flows in the opposite direction so as to drive the FL and RL side motors 36 and 34, thus moving the FL and RL side windows downward simultaneously.

Figure 3H:
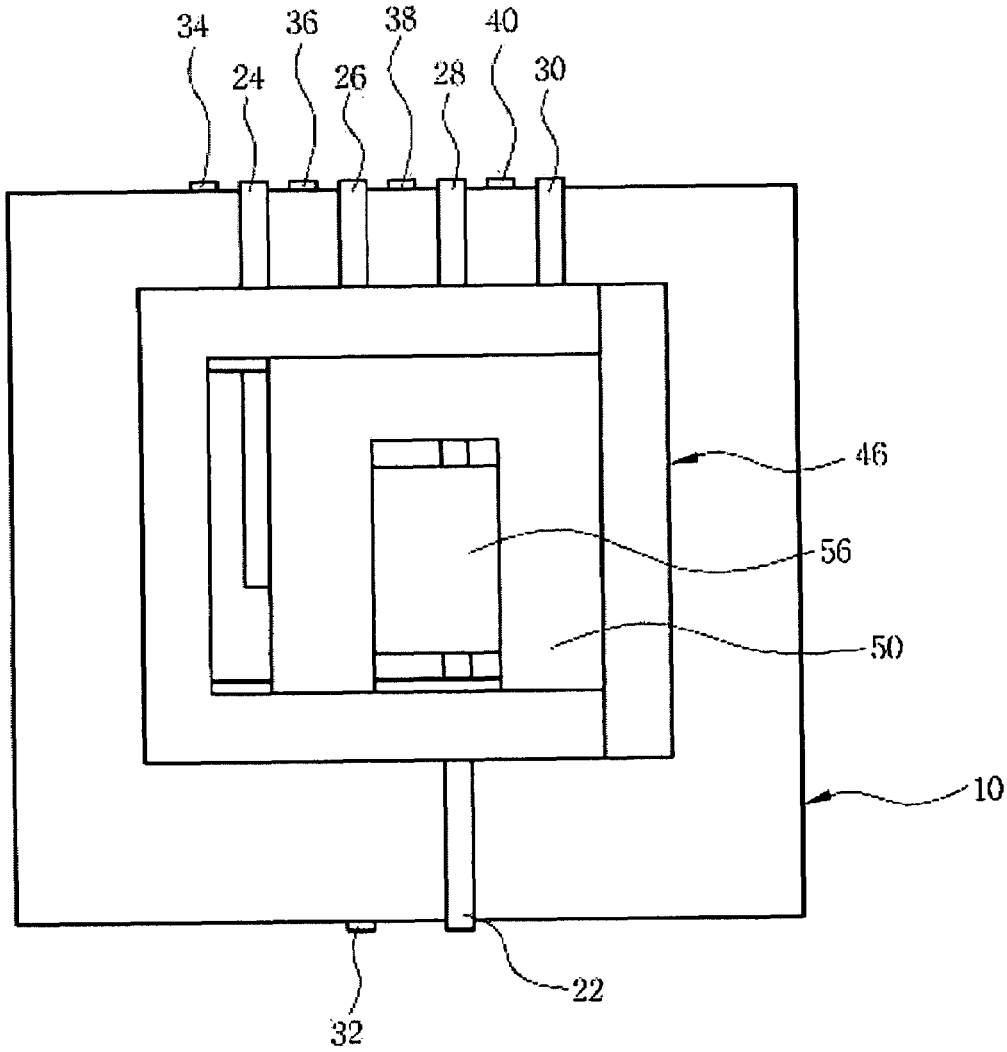
Figure 4H:
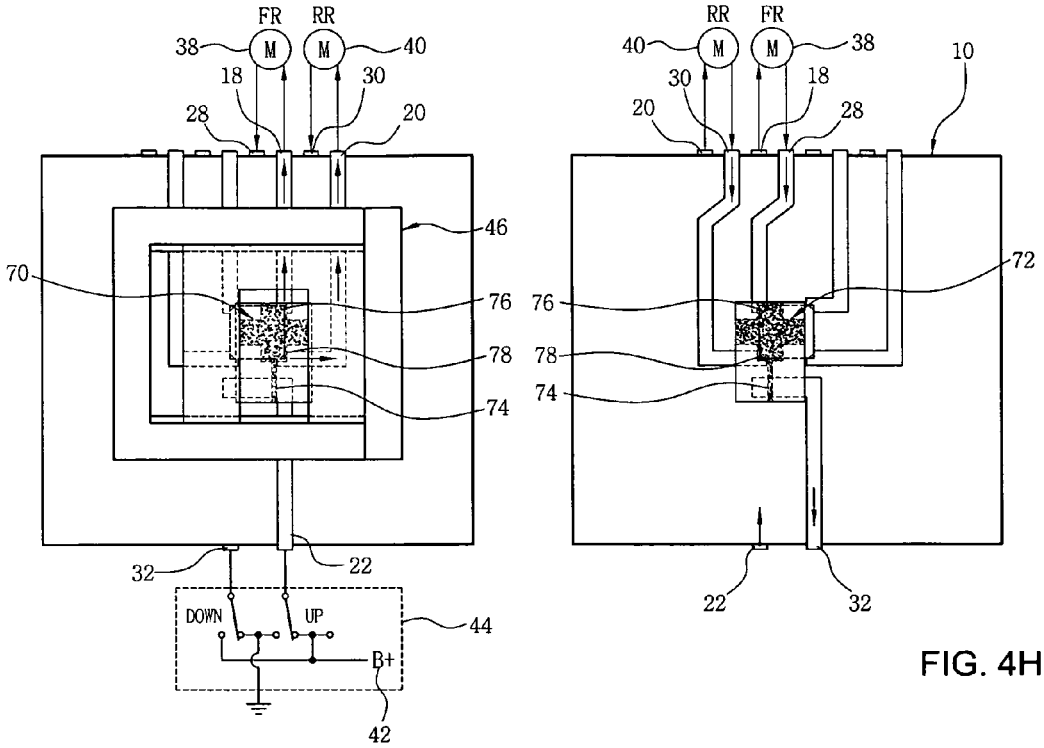
Figure 5:
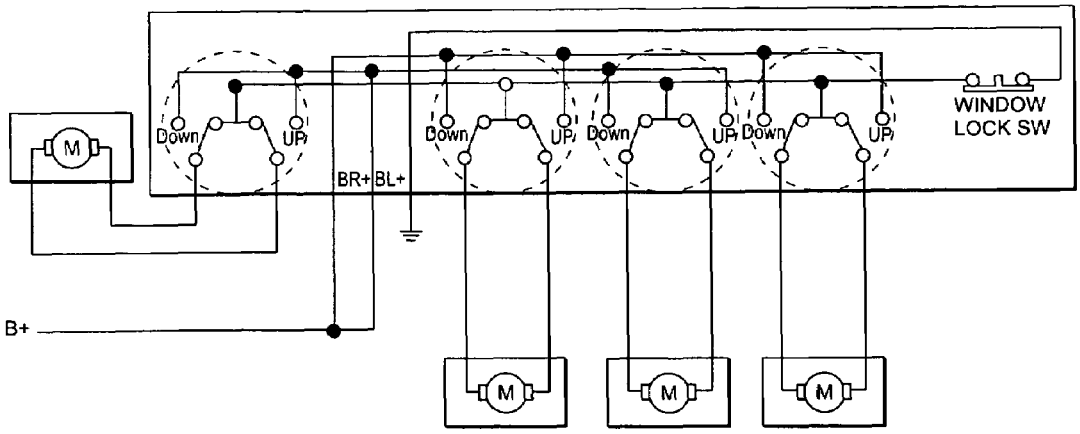
FIG. 5 is a circuit diagram depicting an example of a prior art power window switch.

(8) Simultaneous Opening/Closing Operation Mode of the FR and RR Side Windows (Refer to FIGS. 3H and 4H)

First, the selector switch knob 88 is moved by hand straight in the right direction.

According to the movement of the selector switch knob 88 in the right direction, the first guide ends 48 of the guide body 46 are slid in situ in the first guide grooves 52 of the left/right moving plate 50 and thereby the left/right moving plate 50 is moved in the right direction. Here, the up/down moving plate 56 is being moved in the right direction along the left/right moving plate 50.

Here, when the selector switch knob 88 is moved in the right direction, the up/down moving plate 56 is not moved but kept in a fixed state (neutral state).

Accordingly, the upper conducting terminal 76 of the first conducting plate 70 of the up/down moving plate 56 is being electrically connected to the FR side first conductive line 18 and, at the same time, the lower conducting terminal 78 of the first conducting plate 70 is being electrically connected to the RR side first conductive line 20.

Subsequently, if the window up/down operation switch 44 is operated to the UP side, the battery power is applied to the main conducting terminal 74 of the first conducting plate 70 through the power supply first conducive line 22 and, at the same time, supplied to the FR side first conductive line 18 and the RR side first conductive line 20 through the upper and lower conducting terminals 76 and 78 of the first conducting plate 70 so as to drive the FR side motor 38 coupled to the FR side first conductive line 18 and the RR side motor 40 coupled to the RR side first conductive line 20, thus moving the FR and RR side windows upward simultaneously.

Here, the contact plate 64 is being moved in the same direction along the up/down moving plate 56 and thereby the FR side second conductive line 28 and the RR side second conductive line 30 of the bottom side of the substrate 10 are being electrically connected to the power supply second conductive line 32 by the upper and lower conducting terminals 76 and 78 of the second conducting plate 72 attached on the top surface of the contact plate 64.

The ground connections of the FR and RR side motors 38 and 40 are made through grounding points adjacent to the window up/down operation switch 44 in the sequential order of the motors 38 and 40, the FR and RR side second conductive lines 28 and 30, the upper and lower conducting terminals 76 and 78 of the second conducting plate 72, the power supply second conductive line 32 and the window up/down operation switch 44.

On the contrary, if the window up/down operation switch 44 is operated to the DOWN side, the battery power flows in the opposite direction so as to drive the FR and RR side motors 38 and 40, thus moving the FR and RR side windows downward simultaneously.

(9) Window Lock Mode

The window lock mode is directed to a state where the up/down moving plate 56 and the left/right moving plate 50 are not moved but kept in a neutral state.

That is, since the first conducting plate 70 of the up/down moving plate 56 and the second conducting plate 72 of the contact plate 64 are not being electrically connected to the respective conductive lines, the battery power is not supplied to the respective motors and thereby the windows are not moved up or down even if the window up/down operation switch 44 is operated up or down.

As described above, according to the unified power window switch in accordance with the present invention, it is possible to execute the eight opening/closing operation modes, such as the single opening/closing operation of the FL side window, the single opening/closing operation of the FR side window, the single opening/closing operation of the RL side window, the single opening/closing operation of the RR side window, the simultaneous opening/closing operation of the FL and FR side windows, the simultaneous opening/closing operation of the RL and RR side windows, the simultaneous opening/closing operation of the FL and RL side windows and the simultaneous opening/closing operation of the FR and RR side windows, and the window lock function only by a single switch.

Moreover, since it is possible to exclude the several switches established separately in the existing power window main switch, the present invention can provide free modifications to the design of the unified power window switch and, at the same time, reduce the cost and weight.

The invention has been described in detail with reference to preferred embodiments thereof. However, it will be appreciated by those skilled in the art that changes may be made in these embodiments without departing from the principles and spirit of the invention, the scope of which is defined in the appended claims and their equivalents.

What is claimed is:

1. A unified power window switch for a vehicle comprising:

a substrate including on its top surface a rear left (RL) side first conductive line, a front left (FL) side first conductive line, a front right (FR) side first conductive line, a rear right (RR) side first conductive line, and a power supply first conductive line, which lines are arranged spaced apart from each other at regular intervals, and including on its bottom surface an RL side second conductive line, an FL side second conductive line, an FR side second conductive line, an RR side second conductive line, and a power supply second conductive line, which lines are arranged spaced apart from each other at regular intervals;

an RL side motor coupled between the RL side first conductive line and the RL side second conductive line;

an FL side motor coupled between the FL side first conductive line and the FL side second conductive line;

an FR side motor coupled between the FR side first conductive line and the FR side second conductive line;

an RR side motor coupled between the RR side first conductive line and the RR side second conductive line;

a guide body of a rectangular ring shape attached on the top surface of the substrate;

a left/right moving plate movably connected to the up and down inner surfaces of the guide body for applying an electric current to at least one of the conductive lines on the substrate;

an up/down moving plate inserted into a connecting hole penetrating the middle of the substrate and movably connected to the inner surfaces of the left/right moving plate for applying an electric current to at least one of the conductive lines on the substrate;

a contact plate positioned on the bottom surface of the substrate and connected to the up/down moving plate in a body for applying an electric current to at least one of the conductive lines on the substrate;

a case connected to the top portion of the substrate to cover the substrate and defining a through-hole formed in the middle of the case; and a selector switch knob connected to the top of the up/down moving plate via the through-hole of the case.

2. The unified power window switch as recited in claim 1, wherein the left/right moving plate has the shape of Π and includes a first guide groove formed in the left and right directions on the top and bottom surfaces thereof and a second guide groove formed in the up and down directions on the inner surfaces thereof.

3. The unified power window switch as recited in claim 2, wherein the guide body is provided with a first guide end which is formed in the left and right directions on the up and down inner surfaces of the guide body so as to be inserted into the first guide groove of the left/right moving plate.

4. The unified power window switch as recited in claim 2, wherein the up/down moving plate is provided with a second guide end which is formed in the up and down direction on the left and right lateral surfaces of the up/down moving plate so as to be inserted into the second guide groove of the left/right moving plate.

5. The unified power window switch as recited in claim 1, wherein the guide body is provided with a first guide end which is formed in the left and right directions on the up and down inner surfaces of the guide body so as to be inserted into the first guide groove of the left/right moving plate.

6. The unified power window switch as recited in claim 1, wherein the up/down moving plate is provided with a second guide end which is formed in the up and down direction on the left and right lateral surfaces of the up/down moving plate so as to be inserted into the second guide groove of the left/right moving plate.

7. The unified power window switch as recited in claim 1, wherein the up/down moving plate is provided with a connecting rod which is formed in the middle of the bottom surface of the up/down moving plate in a body and the contact plate defines therein a connecting hole through which the connecting rod is inserted.

8. The unified power window switch as recited in claim 1, wherein the selector switch knob is provided with a connecting projection which is formed on the bottom surface of the selector switch knob and the up/down moving plate defines in the middle of its top surface a connecting groove through which the connecting projection is inserted.

9. The unified power window switch as recited in claim 1, wherein the up/down moving plate comprises a first conducting plate on its bottom surface and the contact plate comprises a second conducting plate on its top surface, both of which conducting plates have same shape and arranged symmetrically.

10. The unified power window switch as recited in claim 9, wherein each of the first and second conducting plates comprises on its surface a main conducting terminal, upper, lower, left and right conducting terminals; the upper, lower, left and right conducting terminals are cross-shaped; and the main conducting terminal is electrically connected to the power supply first and second conductive lines, the upper, lower, left and right conducting terminals.

11. The unified power window switch as recited in claim 1, further comprising a window up/down operation switch between the power supply first and second conductive lines, with the UP side of the window up/down operation switch being connected to the power supply first conductive line and the DOWN side of the window up/down operation switch being connected to the power supply second conductive line.

* * * * *